US008292670B2

(12) United States Patent
Kreider et al.

(10) Patent No.: US 8,292,670 B2
(45) Date of Patent: Oct. 23, 2012

(54) CABLE INTERFACE DEVICE

(75) Inventors: Thom Kreider, Peoria, AZ (US); Mitch Fletcher, Glendale, AZ (US); Brian Cornelius, Glendale, AZ (US); Larry Jackson, Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 185 days.

(21) Appl. No.: 13/037,029

(22) Filed: Feb. 28, 2011

(65) Prior Publication Data

US 2012/0220168 A1 Aug. 30, 2012

(51) Int. Cl.
*H01R 12/00* (2006.01)

(52) U.S. Cl. ..... 439/638

(58) Field of Classification Search ..... 439/638, 439/639, 650

See application file for complete search history.

(56) References Cited

U.S. PATENT DOCUMENTS 5,137,462 A * 8/1992 Casey et al. ..... 439/74
5,299,193 A 3/1994 Szczepanek
5,784,573 A 7/1998 Szczepanek et al.
5,867,669 A 2/1999 Breen et al.
6,028,865 A 2/2000 Rusche et al.
6,257,932 B1 * 7/2001 Neely ..... 439/638
6,648,695 B1 * 11/2003 Wu ..... 439/638
6,757,748 B1 6/2004 Hipp
6,859,854 B2 2/2005 Kwong
6,945,821 B2 * 9/2005 Stoner et al. ..... 439/638
7,421,526 B2 9/2008 Fletcher et al.
7,430,201 B1 9/2008 Shanley et al.
7,479,793 B2 1/2009 Park et al.
7,620,754 B2 11/2009 Yee et al.
7,693,178 B2 4/2010 Wojtowicz
7,783,821 B2 8/2010 Nurmi et al.
7,828,569 B2 11/2010 Aronson et al.
2006/0203842 A1 9/2006 Wollmershauser et al.
2009/0161689 A1 6/2009 Hinderthuer et al.
2010/0215049 A1 8/2010 Raza et al.

* cited by examiner

*Primary Examiner* — Gary F. Paumen
(74) *Attorney, Agent, or Firm* — Ingrassia Fisher & Lorenz, P.C.

(57) ABSTRACT

A cable interface device is provided for physically and electronically connecting two devices. The cable interface device comprises a first pin pickup assembly electrically connectable to a first multi-pin connector of a first electronic device having a first pin geometry. The device also includes a hardware specific signal routing adapter connected electronically and physically in series with the pin pickup assembly and a second pin pickup assembly electrically connectable to a second pin connector of a second electronic device having a second pin geometry, the second pin geometry being electronically and mechanically different from the first pin geometry.

11 Claims, 4 Drawing Sheets

CABLE INTERFACE DEVICE

TECHNICAL FIELD

The present invention generally relates to electronic cable connectors, and more particularly relates to a modular cable interface that by virtue of its construction connects two devices with dissimilar input/output pin geometries.

BACKGROUND

Aircraft and spacecraft are designed utilizing a large number of electronic components from a variety of vendors. Most of these electronic components are designed using as many off the shelf parts as possible to keep manufacturing costs down. Input/output pin connectors used with electronic components are typical examples. A great deal of attention is paid to the size and the combined mass of the cables needed to connect to these pin connectors to the aircraft/spacecraft command and control systems.

For example, a standard 128 pin connector requires a cable with 128 wires or more with wire redundancy and shields. However, many of these wires may not be used because not all of the 128 pins may carry a signal or a source of voltage. As such, the weight of these unused wires is dead weight.

Weight and volume are limiting factors in aircraft and spacecraft design. Accordingly, it is desirable to eliminate any useless or redundant cable weight where lower signal count is possible. In addition, it is desirable to provide a modular cable interface device that is inexpensive and cheaply modified to connect any two devices with disparate pin geometries (e.g. a 128 pin connector to a 58 pin connector). Other desirable features and characteristics of the present invention will become apparent from the subsequent detailed description of the invention and the appended claims, taken in conjunction with the accompanying drawings and this background of the invention.

BRIEF SUMMARY

A cable interface device is provided for physically and electronically connecting two devices. The cable interface device comprises a first pin pickup assembly electrically connectable to a first multi-pin connector of a first electronic device having a first pin geometry. The device also includes a removable hardware specific signal routing adapter connected electronically and physically in series with the pin pickup assembly. The cable interface device also includes a second pin pickup assembly electrically connectable to a second pin connector of a second electronic device having a second pin geometry. The second pin geometry is electronically and mechanically different from the first pin geometry.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

Figure 1:
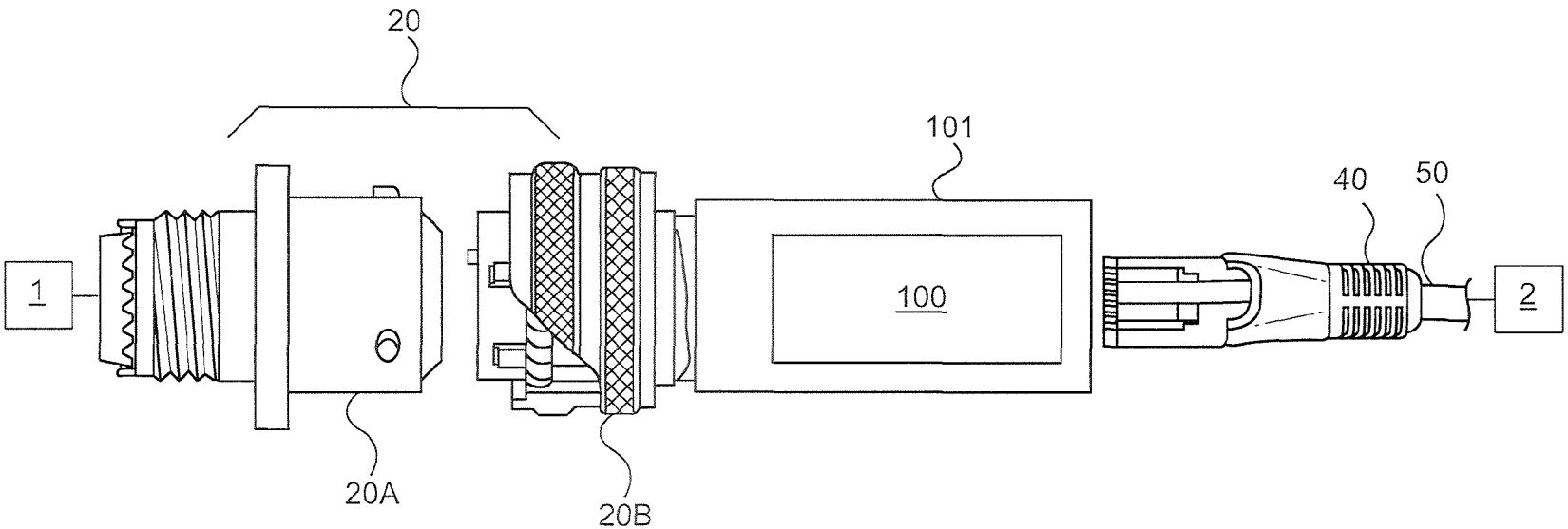
FIG. 1 is an illustration of an exemplary assembled cable interface device according to embodiments.

FIG. 1 is an illustration of a cable interface device 100 in relation to an input/output (I/O) connector 20*a* of a first electronic device 1 and a data transmission cable connector 40. The I/O connector 20*a* may be any standard or proprietary mechanical cable connection 20 known in the art or that may be devised in the future. Such connectors 20*a* typically have specific fixed female pin geometry. The housing of connector 20*b* fits onto the I/O connector 20*a* of the first electronic device 1 where the pin geometry of connector 20*b* engages the female contacts of connector 20*a*, which is arranged in the same pin geometry. However, those of ordinary skill in the art will appreciate that connector 20*a* may have male pins and the connector 20*b* may have female counterpart connectors.

Similarly, the data transmission cable connector 40 may also be any standard or proprietary mechanical cable connection 40 known in the art or that maybe devised in the future. Such connectors 40 have specific, fixed pin or connector geometries. The connector 40 fits onto or into a receptacle in the end of the cable interface device 100 where the pin geometry engages the contacts arranged in the same or in complementary connector/pin geometry within the connector 40 of cable 50.

The function of the cable interface device 100 is to dispense with a cable length of a large cable and replace it with a smaller cable. The cable interface device 100 allows the movement of the electronic signals and the mechanical conversion components from an arbitrary second electronic device 2 at the distal end of a heavy transmission cable (not shown) to a backshell 101 of the I/O connector 20*b* connected to the first electronic device 1. The device 100 thus allows a smaller data cable to run the distance between the first and second electronic devices instead of a heavier cable that may normally be required by the I/O connector 20*a*. By allowing the use of smaller cable, the cable weight may be reduced.

Figure 2:
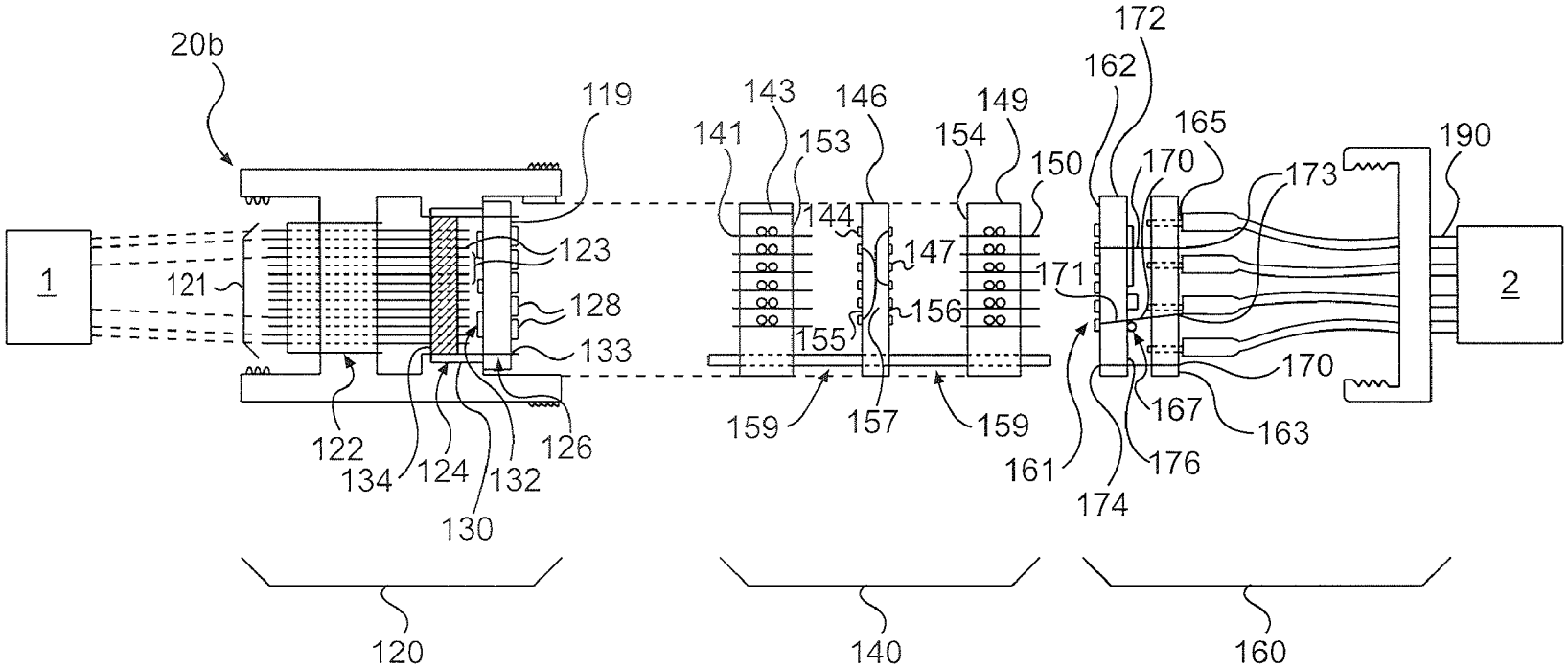
FIG. 2 is an exploded illustration of an exemplary cable interface device according to embodiments.

FIG. 2 is an exploded view of the cable interface device 100, which comprises three assemblies. The three assemblies are a first pin pickup assembly 120, a removable hardware specific routing adapter 140, and a second pin pickup assembly 160.

The first pin pickup assembly 120 is enclosed in a modified barrel type connector shown with a form factor 20*b*. Those of ordinary skill in the art will appreciate that in equivalent embodiments the connector 20*b* may be a male connector or female connector or in an alternative form factor. However, in the interest of brevity and simplicity, the discussion below will assume that connectors are multi-pin male connectors unless otherwise indicated.

The first pin pickup assembly 120 comprises a first set of conductors 122 arranged in a geometry that is compatible with a corresponding female I/O connector 20*a* (See, FIG. 1). Each conductor of the set of conductors 122 has a first end 121 and a second end 123. The first ends 121 of the set of conductors 122 may be exposed pins that mate with corresponding female pin receptacles in I/O connector 20*a*. The second ends 123 of the set of conductors 122 extends through the axial length of the barrel connector 20*b* and are secured proximate to their second end by, and may extend through, a pin pickup form factor 124.

The pin pickup form factor 124 is preferably a slab, disk or substrate of insulating material that may be fixedly secured with in the connector 20*b* as shown in FIG. 2. The shape, orientation and location of the pin pickup form factor 124 within the connector 20*b* are exemplary. Variations to the pin pickup form factor illustrated in the example of FIG. 2 may be used in equivalent embodiments without departing from the scope of the disclosure herein. As further non-limiting examples, the first pin pickup form factor 124 may consist of plastic, ceramic or other suitable insulating material.

The first pin pickup assembly 120 also comprises a terminal substrate 126. The terminal substrate 126 includes a set of conducting points or pads 128 arranged upon its exterior face 119 in a pin geometry that differs from the pin geometry of the first set of conductors 122. The second ends 123 of the conductors of each set of conductors 122 may extend through the terminal substrate 126 and each end is electrically and mechanically terminated at a pad 128.

Figure 3:
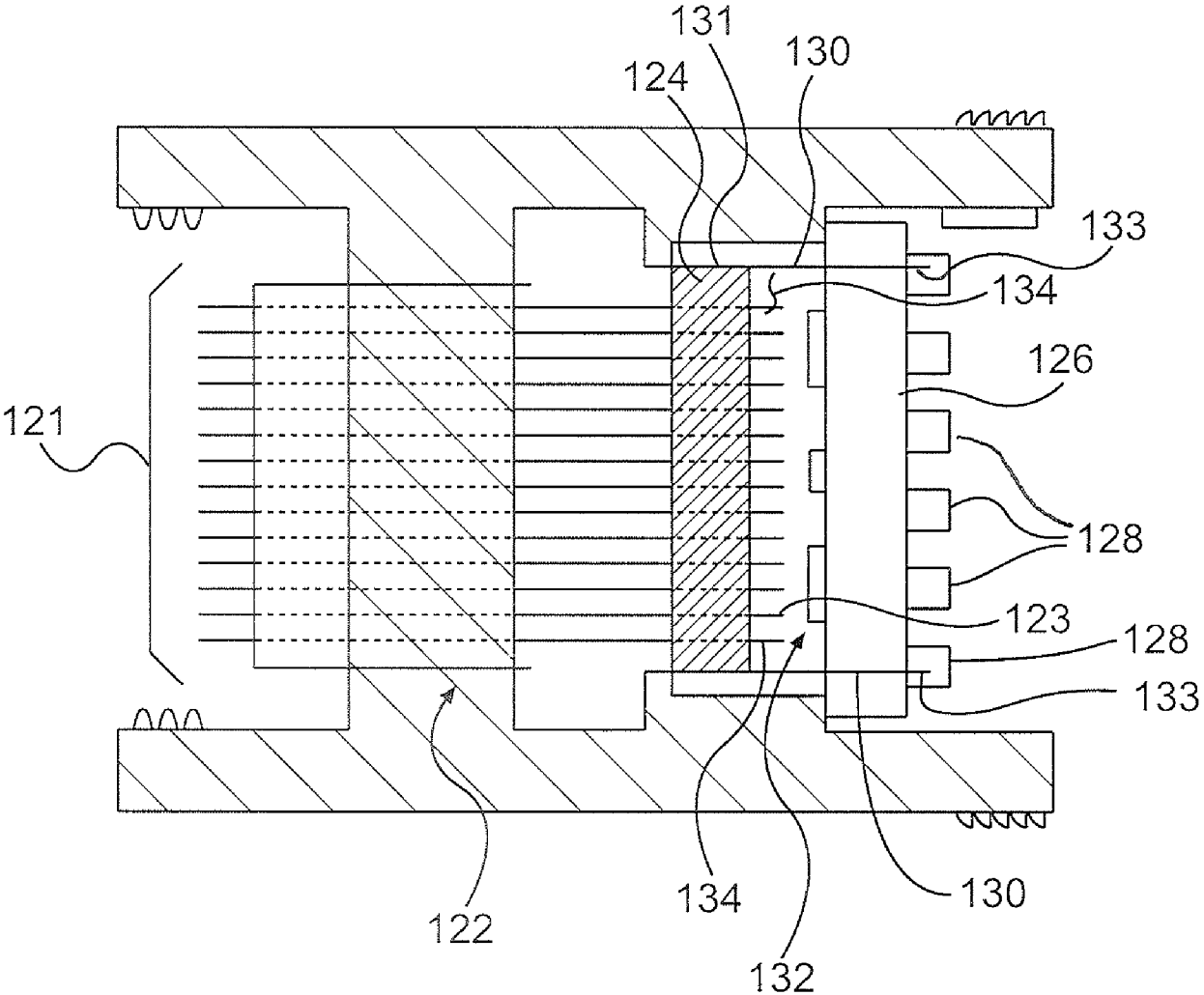
FIG. 3 is an external assembled illustration and an exploded illustration of an exemplary first pin pickup assembly according to embodiments.
Figure 3A:
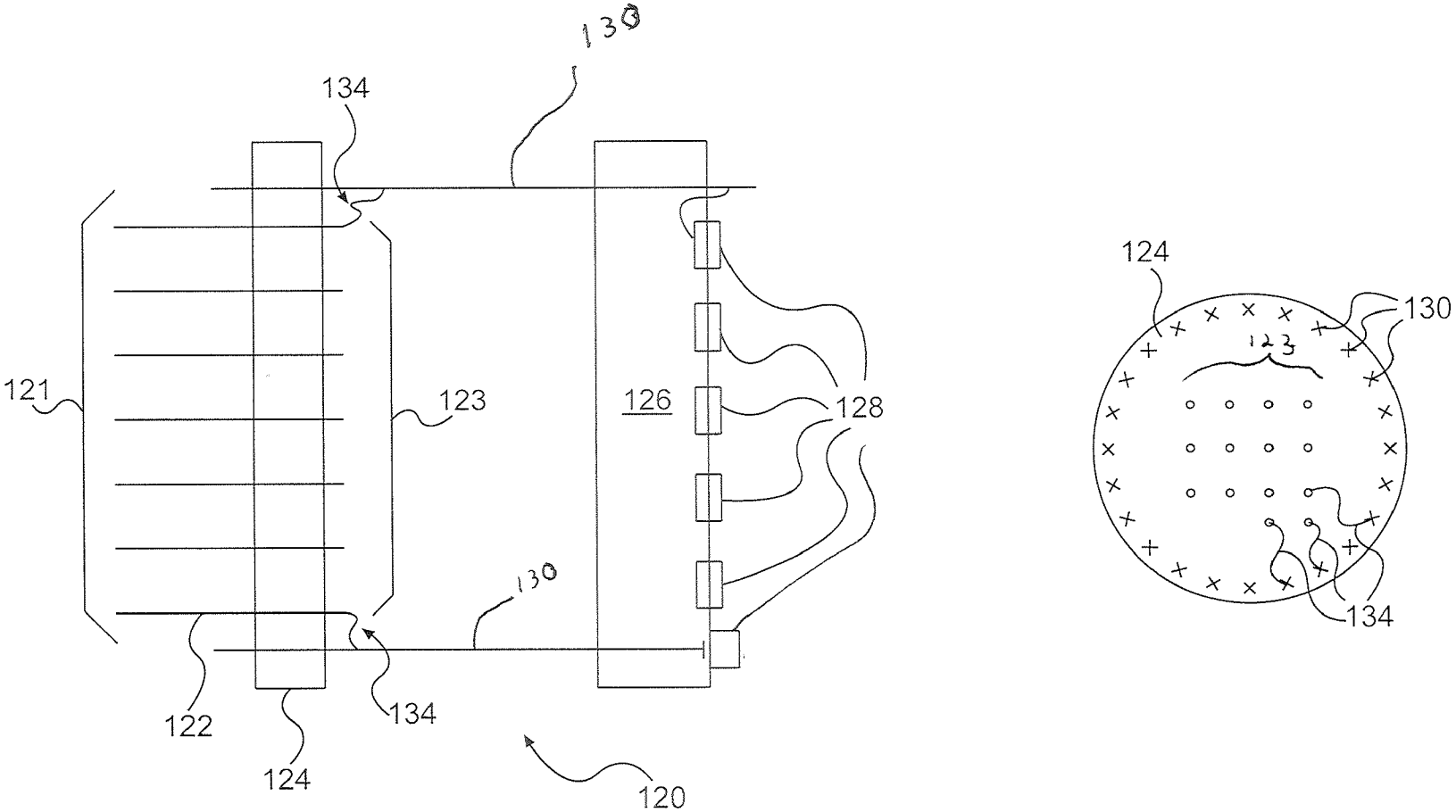

In an equivalent embodiment of FIG. 3, the first set of conductors 122 passes through the first pin pickup form factor 124 and terminates at the far side of the first pin pickup form factor. In some embodiments, the first pin pickup assembly 120 may also comprise a second set of conductors 130 arranged in a second pin geometry that is different from the first pin geometry. The second set of conductors 130 may be axial conductors with a first end 131 and a second end 133. The first ends 131 of the second set of conductors 130 may be secured by the first pickup form factor 124. The second ends 133 of the second set of conductors 130 may pass through the terminal substrate 126 and each end of the second set of conductors electrically terminate at a conducting pad 128. The first end 131 of each of the second set of conductors 130 may be electrically connected by electrical connection 134 to the second end 123 of one of the first conductors 122 (see, e.g., FIG. 3*a*). The purpose of the second set of conductors 130 is to permit the conduction pads 128 to make contact with a first plurality of conducting pins 141 (See, FIG. 2). The second set of conductors also creates space on the interior surface of the first pickup form factor 124 for one or more identification resistors 132 by rearranging pin geometry from the first pin geometry to the second pin geometry.

Referring again to FIG. 2, the removable hardware specific routing adapter 140 comprises a first mating boot 143, a second mating boot 149 and a pin routing form factor 146 that is removably sandwiched/fixed between a back side 153 of the first mating boot 143 and the front side 154 of the second mating boot 149.

The pin routing form factor 146 comprises a front side 155 and a back side 156 with a second set of conducting elements 144 arranged on the front side 155 and a third set of conducting elements 147 arranged on the back side 156. The pin routing form factor 146 also comprises a hardware specific connection fabric 157 electrically connecting at least one of the second set of conducting elements 144 to one or more of the third set of conducting elements 147 as desired to meet application-specific requirements. The connections may be one-to-one, one-to-many, or many-to-one across the connection fabric 157.

The first mating boot 143 includes a first plurality of conducting pins 141 penetrating completely through the first mating boot and that are arranged to engage at least one of the first set of conducting elements 128 of the terminal substrate 126 and at least one of the second set of conducting elements 144 of the pin routing form factor 146. The second mating boot 149 includes a second plurality of conducting pins 150 penetrating through the second mating boot that are arranged to engage at least one the third set of conducting elements 147 pin routing form factor 146 and at least one of the fourth set of conducting elements 161 of the second pin pickup assembly 160.

The first and second pluralities of conducting pins (141, 150) may be any type of conducting pins known in the art or that may be devised in the future. In some embodiments the preferred type of conducting pins are spring loaded or utilize a similar type of compression mechanism for maintaining contact and compensating for vibration and thermal expansion between parts connected by the conducting pins. Exemplary types of conducting pins may include Pogo pins, fuzz buttons, and the like.

The pin routing form factor 146 also includes a hardware specific connection fabric 157. The hardware specific connection fabric 157 is a network or a collection of electrical connectors, printed circuit board (PCB) traces, or wires connecting the various elements of the second set of conducting elements 144 to the various elements of the third set of conducting elements 147. The hardware specific connection fabric 157 is a conversion means for translating the pin geometry of the set of conductors 122/130 of the first pin pickup assembly 120 to the pin geometry 165 of the second pin pickup assembly 160.

The various parts of the removable hardware specific routing adapter 140 may be releasably secured together by a securing means 159. The securing means 159 may be any securing device known in the art or that may be developed in the future. An exemplary, non-limiting example of a securing means include: a bolt, a pin, a rod, a clasp, a screw and the like.

To connect a new and different arbitrary electronic device 2 having different pin geometry from that of an old electronic device 2, a technician disengages the securing means 159. The technician then replaces the existing removable hardware specific routing adapter 140 with a new removable hardware specific routing adapter that corresponds to the pin geometry of the new electronic device 2 on one side and the pin geometry of electronic device 1 on the other side.

Continuing with FIG. 2, the second pin pickup assembly 160 comprises a set of axial conductors 170 each with a first end 171 and a second end 173. The second end 173 of the second set of conductors 170 is arranged to electrically connect a conductor 165 of the pin geometry 190 of the second electronic device 2.

The second pin pickup assembly 160 includes a pin pickup form factor 172 configured to secure the second end 173 of the set of axial conductors 170 and includes a terminal substrate 163 with an internal surface 162 and an external surface 176. The terminal substrate 163 is configured to accept the first end 171 of each of the second set of conductors 170 at its external surface 176 and pass the set of axial conductors 170 therethrough.

The second pin pickup assembly 160 further includes a fourth set of conducting elements 161 disposed on the internal surface of the terminal substrate 163. Each conducting element of the fourth set of conducting elements is electrically connected to the first end of one of the set of axial conductors 170.

In some embodiments, the second terminal substrate may comprise a universal input/output (I/O) interface circuit 167 electronically connected between the fourth set of conducting elements 161 and a pin 165 of the second pin geometry of the second electronic device 2. The purpose of the universal I/O interface circuit 167 is to provide a re-configurable signal conditioning circuit with multiple input and output functionality to the second electronic device 2. Elements normally associated with input signal conditioning functionality are uniquely combined with elements normally associated with output conditioning functionality, thereby allowing multiple uses of a common universal I/O circuit element for various applications. Non-limiting examples of such universal I/O circuits may be found in co-owned, co-pending application Ser. Nos. 12/750,341 and 12/768,448 to Fletcher, which are incorporated herein by reference in their entirety.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A cable interface device comprising:

a first set of conductors with a first end and a second end;

a first pin pickup assembly electrically connectable to a first multi-pin connector of a first electronic device having a first pin geometry, the first pin pickup assembly comprising a first terminal substrate with an internal surface and an external surface, the first terminal substrate configured to accept the second end of each of the first set of conductors at the internal surface;

a pin pickup form factor configured to secure the second end of each conductor of the set of conductors;

a hardware specific signal routing adapter connected electronically and physically in series with the first pin pickup assembly; and a second pin pickup assembly electrically connectable to a second pin connector of a second electronic device having a second pin geometry, the second pin geometry being electronically and mechanically different from the first pin geometry.

2. The cable interface device of claim 1, wherein the first pin pickup assembly comprises:

a conductor of the first pin geometry of the first electronic device arranged to engaged engage each first end of the first set of conductors;

a pin pickup form factor configured to secure the second end of each conductor of the set of conductors; and a first set of conducting elements disposed on the external surface of the first terminal substrate, each conducting element of the first set of conducting elements terminating one second end of the first set of conductors.

3. The cable interface device of claim 1, wherein the first pin pickup assembly comprises:

a first set of conductors each with a first end and a second end, each first end of the set of conductors arranged to engage a conductor of the first pin geometry of the first electronic device;

a pin pickup form factor configured to secure the second end of each conductor of the first set of conductors;

a first terminal substrate with an internal surface and an external surface, the first terminal substrate configured to accept the second end of each of the first set of conductors at the internal surface, a set of axial conductors each with a first end and a second end, the first end of each of the set of axial conductors is connected to the second end of one of the first set of conductors, and a first set of conducting elements disposed on the external surface of the first terminal substrate, each conducting element of the first set of conducting elements terminating one second end of the set of axial conductors.

4. The cable interface device of claim 2, wherein the hardware specific signal routing adapter comprises:

a first mating boot with a front side and a back side;

a second mating boot with a front side and a back side;

a pin routing form factor removably sandwiched between the back side of the first mating boot and the front side of the second mating boot, the pin routing form factor comprising:

a front side and a back side, a second set of conducting elements arranged on the front side, a third set of conducting elements arranged on the back side, and an hardware specific connection fabric electrically connecting at least one of the second set of conducting elements to one or more of the third set of conducting elements;

a first plurality of conducting pins penetrating through the first mating boot, the first plurality of conducting pins arranged to engage at least one of the first set of conducting elements and at least one of the second set of conducting elements; and a second plurality of conducting pins penetrating through the second mating boot, each conducting pin of the first plurality of conducting pins arranged to engage at least one of the third set of conducting elements.

5. The cable interface device of claim 4, wherein the second pin pickup assembly comprises:

a second set of conductors each with a first end and a second end, each second end of the second set of conductors arranged to engage a conductor of the second pin geometry of the second electronic device;

a pin pickup form factor configured to secure the first end of the second set of conductors;

a second terminal substrate with an interior surface and an external surface, the second terminal substrate configured to accept the first end of each of the second set of conductors at the interior surface, and a fourth set of conducting elements disposed on the external surface of the second terminal substrate, each conducting element of the fourth set of conducting elements electrically terminating one second end of the second set of conductors.

6. The cable interface device of claim 5, wherein the second terminal substrate comprises a universal input/output (I/O) interface circuit electronically connected between at least one of the fourth set of conducting elements and a pin of the second pin geometry of the second electronic device.

7. The cable interface device of claim 2, wherein the first terminal substrate comprises one or more identification resistors electronically connected between at least one of the first set of conducting elements and a pin of the first pin geometry of the first electronic device.

8. The cable interface device of claim 1, further comprising a connector housing configured to releasably engage the first pin geometry of the first electronic device to the hardware specific signal routing adapter.

9. The cable interface device of claim 8, wherein the first pin pickup assembly, the second pin pickup assembly and the hardware specific signal routing adapter are contained with in a backshell.

10. A hardware specific signal routing adapter for use in a cable interface device comprising:

a first mating boot with a front side and a back side;

a second mating boot with a front side and a back side;

a pin routing form factor removably sandwiched between the back side of the first mating boot and the front side of the second mating boot;

a first plurality of conducting pins penetrating through the first mating boot, the first plurality of conducting pins arranged to engage at least one of a first set of conducting elements and at least one of a second set of conducting elements; and a second plurality of conducting pins penetrating through the second mating boot, each conducting pin of the first plurality of conducting pins arranged to engage at least one of a third set of conducting elements.

11. The hardware specific signal routing adapter of claim 10, wherein the pin routing form factor comprises:

a front side and a back side, the second set of conducting elements arranged on the front side, the third set of conducting elements arranged on the back side, and a hardware specific connection fabric electrically connecting at least one of the second set of conducting elements to one or more of the third set of conducting elements.

* * * * *